US010054090B2

(12) United States Patent
Schmidbauer

(10) Patent No.: US 10,054,090 B2
(45) Date of Patent: Aug. 21, 2018

(54) HIGH-PRESSURE FUEL PUMP

(71) Applicant: Continental Automotive GmbH, Hannover (DE)

(72) Inventor: Thomas Schmidbauer, Falkenstein (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 15/127,524

(22) PCT Filed: Aug. 20, 2015

(86) PCT No.: PCT/EP2015/069167
§ 371 (c)(1),
(2) Date: Sep. 20, 2016

(87) PCT Pub. No.: WO2016/058736
PCT Pub. Date: Apr. 21, 2016

(65) Prior Publication Data

US 2018/0171950 A1 Jun. 21, 2018

(30) Foreign Application Priority Data

Oct. 14, 2014 (DE) ..... 10 2014 220 746

(51) Int. Cl.
*F02M 59/00* (2006.01)
*F02M 59/10* (2006.01)
*F02M 59/44* (2006.01)

(52) U.S. Cl.
CPC ..... *F02M 59/102* (2013.01); *F02M 59/44* (2013.01); *F01L 2107/00* (2013.01); *F02M 2200/80* (2013.01)

(58) Field of Classification Search
CPC ..... F02M 59/102; F02M 59/44; F02M 59/10; F01L 2107/00
See application file for complete search history.

(56) References Cited

U.S. PATENT DOCUMENTS 5,094,197 A * 3/1992 Rosa ..... F01L 1/143 123/308
5,402,756 A * 4/1995 Bohme ..... F01L 13/0005 123/198 F (Continued)

FOREIGN PATENT DOCUMENTS

AT 302727 B 10/1972 ..... F02M 59/102
CN 102472218 A 5/2012 ..... F02M 59/10

(Continued)

OTHER PUBLICATIONS

Chinese Office Action, Application No. 201580011637.3, 11 pages, dated May 3, 2017.

(Continued)

*Primary Examiner* — Thomas Moulis
(74) *Attorney, Agent, or Firm* — Slayden Grubert Beard PLLC

(57) ABSTRACT

The present disclosure relates to fuel systems. Some embodiments of the teachings may include a fuel pump comprising: a pump piston having a longitudinal centerline; a camshaft with at least one cam; a roller tappet arranged between the pump piston and the cam; and a tappet body and a roller rotatably held on the roller tappet. The pump piston and the tappet body may be movement-coupled with regard to movements in directions parallel to the piston longitudinal centerline. The roller may be in contact with the cam. The longitudinal centerline may intersect a geometric axis of rotation of the roller. The tappet body defines a tappet body longitudinal centerline parallel to the piston longitudinal centerline. The tappet body longitudinal centerline, in a projected view oriented parallel to the geometric axis of rotation of the roller, runs with a lateral spacing to the piston longitudinal center line.

11 Claims, 4 Drawing Sheets

(56) References Cited

U.S. PATENT DOCUMENTS

| | | | | | |
|---|---|---|---|---|---|
| 5,415,138 | A * | 5/1995 | Hudson | F01L 1/146 | 123/90.43 |
| 5,860,398 | A * | 1/1999 | Koerner | F01L 1/08 | 123/90.35 |
| 6,431,842 | B1 * | 8/2002 | Furuta | F02M 59/102 | 123/495 |
| 6,435,150 | B1 * | 8/2002 | Loughlin | F01L 1/14 | 123/90.48 |
| 6,991,438 | B2 * | 1/2006 | Blessing | F04B 1/0426 | 417/273 |
| 7,134,846 | B2 * | 11/2006 | Djordjevic | F02M 59/102 | 417/273 |
| 9,702,329 | B2 * | 7/2017 | Rosu | F02M 69/50 | |
| 2013/0266465 | A1 * | 10/2013 | Akita | F02M 53/00 | 417/443 |
| 2015/0211454 | A1 * | 7/2015 | Tanabe | F04B 1/0413 | 417/364 |

FOREIGN PATENT DOCUMENTS

| | | | | |
|---|---|---|---|---|
| DE | 102008001718 | A1 | 11/2009 | F02M 59/10 |
| DE | 102008019072 | B3 | 12/2009 | F04B 9/04 |
| DE | 102009014833 | A1 | 9/2010 | F01L 1/047 |
| DE | 102009047568 | A1 | 6/2011 | F02M 59/10 |
| DE | 102010027749 | A1 | 10/2011 | F02M 59/00 |
| EP | 1347172 | A2 | 9/2003 | F04B 1/04 |
| EP | 2487360 | A1 | 8/2012 | F02M 59/10 |
| JP | 05072043 | A | 3/1993 | F24F 11/02 |
| JP | 5272428 | A | 10/1993 | F02M 59/10 |
| JP | 09264229 | A | 10/1997 | F02M 59/40 |
| JP | 10159681 | A | 6/1998 | F02M 59/10 |
| JP | 2000220554 | A | 8/2000 | F02M 39/02 |
| JP | 2009236041 | A | 10/2009 | F02M 59/10 |
| JP | 2010248974 | A | 11/2010 | F02M 59/10 |
| JP | 2013096328 | A | 5/2013 | F02M 59/10 |
| WO | 2005/088125 | A1 | 9/2005 | F04B 1/04 |
| WO | 2016/058736 | A1 | 4/2016 | F02M 59/10 |

OTHER PUBLICATIONS

German Office Action, Application No. 102014220746.0, 5 pages, dated Aug. 12, 2015.

International Search Report and Written Opinion, Application No. PCT/EP2015/069167, 15 pages, dated Oct. 26, 2015.

* cited by examiner

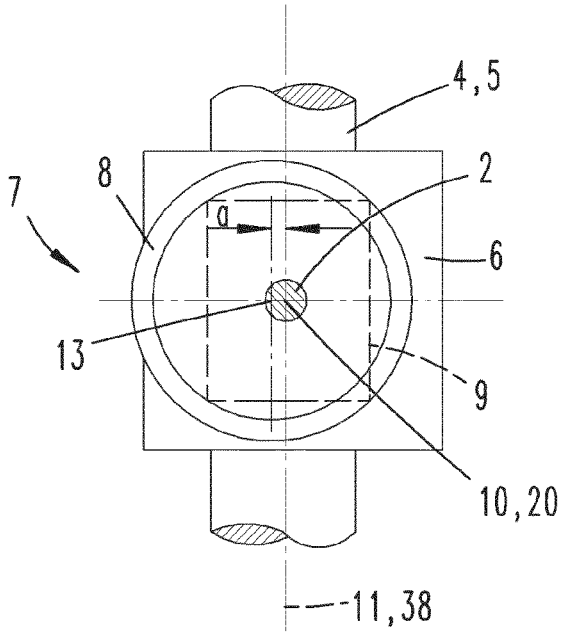
Fig. 2a
Fig. 2b
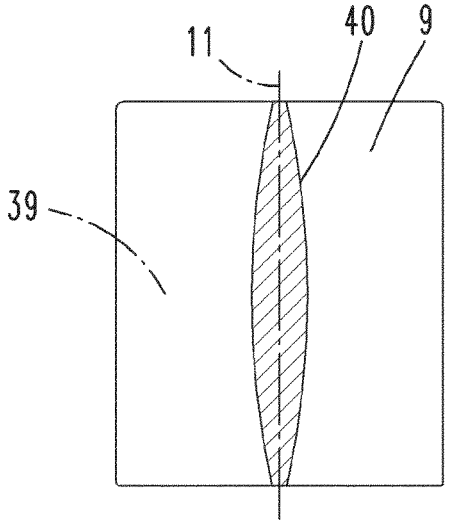
Fig. 2c
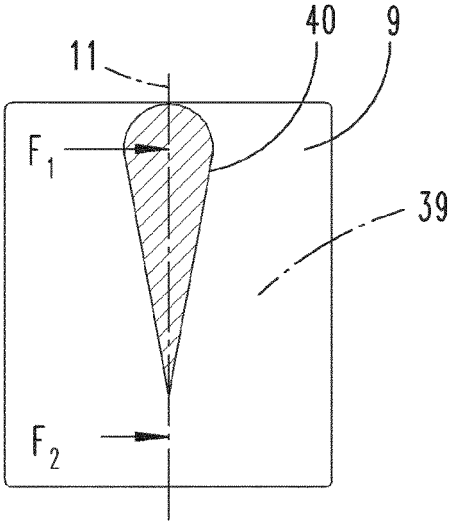

HIGH-PRESSURE FUEL PUMP

CROSS-REFERENCE TO RELATED APPLICATIONS

This application is a U.S. National Stage Application of International Application No. PCT/EP2015/069167 filed Aug. 20, 2015, which designates the United States of America, and claims priority to DE Application No. 10 2014 220 746.0 filed Oct. 14, 2014, the contents of which are hereby incorporated by reference in their entirety.

TECHNICAL FIELD

The present disclosure relates to fuel systems in general and the teachings may be applied to a fuel pump.

BACKGROUND

Fuel pumps may be used for example as high-pressure fuel pumps for fuel injection systems of internal combustion engines. In typical systems, a fuel pump may include a pump piston, a camshaft which has at least one cam, and a roller tappet which is arranged between the pump piston and the cam and which has a tappet body and a roller rotatably held thereon. The pump piston and the tappet body are movement-coupled with regard to movements in directions parallel to the piston longitudinal centerline. The roller stays in contact with the cam and a geometric reference line which forms a rectilinear elongation of the piston longitudinal centerline intersects the geometric axis of rotation of the roller. Finally, the tappet body has a tappet body longitudinal centerline which is parallel to the reference line.

SUMMARY

According to teachings of the present disclosure, a fuel pump (1) may include: a pump piston (2), a camshaft (4) which has at least one cam (6), and a roller tappet (7) which is arranged between the pump piston (2) and the cam (6). The roller tappet (7) has a tappet body (8) and a roller (9) rotatably held thereon. The pump piston (2) and the tappet body (8) are movement-coupled with regard to movements in directions parallel to the piston longitudinal centerline (10), wherein the roller (9) is in contact with the cam (6). A geometric reference line (20) which forms a rectilinear elongation of the piston longitudinal centerline (10) intersects the geometric axis of rotation (11) of the roller (9). The tappet body (8) has a tappet body longitudinal centerline (13) which is parallel to the reference line (20), characterized in that the tappet body longitudinal centerline (13), in a projected view oriented parallel to the geometric axis of rotation (11) of the roller (9), runs with a lateral spacing (a) to the geometric reference line (20).

In some embodiments, at least at top dead center and in particular at bottom dead center of the roller (9), in the projected view, the contact zone (37) between cam (6) and roller (9) is situated so as to be laterally spaced apart from the tappet body longitudinal centerline (13).

In some embodiments, the geometric reference line (20) intersects the geometric axis of rotation (38) of the camshaft (4).

In some embodiments, in the projected view, the tappet body longitudinal centerline (13) is situated on that side of the reference line (20) which, with regard to the direction of circumferential movement of the cam (6), selected for operation, in the contact zone of cam (6) and roller (9), is situated in front of the reference line (20) or which, with regard to the direction of circumferential movement of the cam (6), selected for operation, in the contact zone of cam (6) and roller (9), is situated behind the reference line (20).

In some embodiments, the tappet body (8) is guided in a tappet body guide (14) so as to be movable in directions parallel to the tappet body longitudinal centerline (13), in that a guide surface (41) of the tappet body (8) lies on or within an inner cylindrical envelope, in that a guide surface (42) of the tappet body guide (14) lies on or outside an outer cylindrical envelope, and in that the diameter of the inner envelope is smaller than the diameter of the outer envelope.

In some embodiments, the outer guide surface (41) of the tappet body (8) and the inner guide surface (42) of the tappet body guide (14) run in each case in continuously cylindrical fashion along their entire respective circumference around the tappet body longitudinal centerline (13).

In some embodiments, the reference line (20) and the tappet body longitudinal centerline (13) lie in a common geometrical plane which extends perpendicular to the geometric axis of rotation (38) of the camshaft (4).

In some embodiments, the tappet body (8) is supported by way of a compression spring (33) against that region of the housing (15) of the fuel pump (1) which is adjacent to a cylinder chamber (23) which interacts with the pump piston (2), and/or in that the pump piston (2) is supported against the tappet body (8) in a direction which leads away from the cylinder chamber (23) and which is parallel to the piston longitudinal centerline (10).

In some embodiments, the fuel pump (1) is a high-pressure fuel pump which is suitable, and in particular designed, for compressing fuel to a pressure of over 100 bar, in particular to a pressure of between 150 and 250 bar, or to a pressure of over 1000 bar, in particular to a pressure of between 1500 and 2500 bar.

In some embodiments, the pump piston (2) has an outer guide surface which, with an inner guide surface of a pump piston guide, forms a longitudinal guide in the direction of the piston longitudinal centerline (10), and in that the outer guide surface of the pump piston (2) and the inner guide surface of the pump piston guide run, along their entire respective circumference, concentrically and cylindrically around the piston longitudinal centerline (10).

BRIEF DESCRIPTION OF THE DRAWINGS

Below, a known fuel pump will be discussed with reference to the appended FIGS. 1, 1*a* and 1*b*, and an exemplary embodiment of a fuel pump incorporating teachings of the present disclosure will be discussed with reference to the appended FIGS. 2, 2*a*, 2*b*, 2*c* and 2*d*. In the figures, in detail:

FIG. 2*a* shows a sectional view along section plane IIa-IIa as per FIG. 2, with the compression spring omitted and on a different scale to FIG. 2;

FIG. 2*b* shows, schematically and in a slightly different size in relation to FIG. 2*a*, a plan view of the roller with a symmetrical line load acting on it at its contact line, indicated by dashed lines, with the cam;

FIG. 2*c* shows, schematically and in a slightly different size in relation to FIG. 2*a*, a plan view of the roller with an asymmetrical line load acting on it at its contact line, indicated by dashed lines, with the cam.

DETAILED DESCRIPTION

Figure 1:
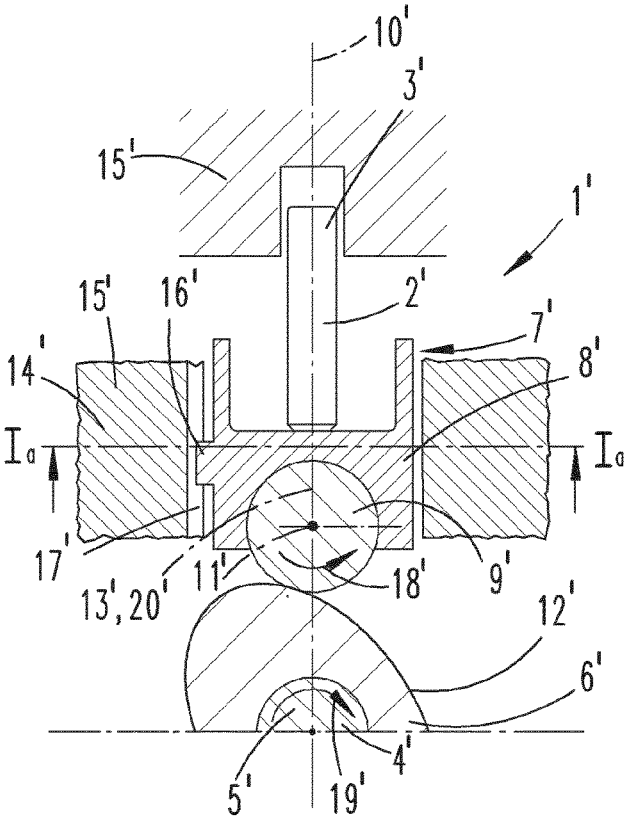
Fig. 1 (Prior Art)
FIG. 1 shows, in a longitudinal section and in schematically simplified form, components and the arrangement thereof in the case of a known fuel pump.

In general, the roller of the roller tappet bears against the circumferential surface of the cam. The tappet is received, by way of its tappet body, in a tappet body guide so as to be movable in directions parallel to the tappet body longitudinal centerline. When the camshaft rotates about its geometric (that is to say imaginary linear) axis of rotation during operation, the roller tappet is moved back and forth in mutually opposite directions parallel to its tappet body longitudinal centerline. The geometric axis of rotation of the camshaft is the imaginary line about which exclusively the camshaft rotates.

For as long as the spacing between the contact zone between roller and cam and the geometric axis of rotation of the camshaft decreases in size during the rotation of the cam, the pump piston, generally supported by a spring, is retracted out of the pump chamber during the so-called suction phase, whereby said pump piston performs a so-called intake stroke. On the other hand, when the spacing between the contact zone between roller and cam and the geometric axis of rotation of the camshaft increases in size during the rotation of the cam, the pump piston is, by way of the tappet body, and during the so-called pressure phase and with one of its longitudinal ends to the fore, moved into the cylinder chamber of the pump piston, wherein said pump piston performs a so-called compression stroke. In each case upon the transition from a suction phase to a pressure phase, the roller is situated at the so-called bottom dead center, whereas, upon every transition from a pressure phase to a suction phase, said roller is situated at the so-called top dead center. This principle of a so-called radial piston pump is known wherein, in the case of known fuel pumps of said type, the tappet body longitudinal centerline and the reference line lie on a common geometric straight line.

A line load acts in the contact zone between the roller and the cam, which line load is dependent inter alia on the pressure force that is exerted on the roller tappet by way of a compression spring which is supported against the housing of the fuel pump. During operation, the line load that acts on the roller in the contact zone is not always constant over the entire length of the contact zone, but rather may be unevenly distributed for example owing to even slight shape and/or position deviations with respect to the roller center. This then results in an introduction of force into the roller which is asymmetric in relation to the roller center, that is to say in relation to the position at the middle of the roller length. This can give rise to a torque about a torque axis which is perpendicular to the geometric axis of rotation of the roller.

In the case of fuel pumps known from the prior art, an asymmetrical introduction of force via the roller contact point may under some circumstances have the effect, in particular when the roller passes through top dead center but also when the roller passes through bottom dead center, that the tappet body rotates about its tappet body longitudinal centerline if no skewing prevention means is provided. A rotation of the tappet body may block, and ultimately destroy, the pump drive.

In the prior art, to prevent skewing of the tappet body, it has been attempted to prevent any asymmetrical introduction of force in particular through a restriction of production tolerances. This however entails high outlay and high costs. Therefore, fuel pumps are known which, to prevent skewing of the tappet body, have form-fitting skewing prevention means. For example, the tappet body has a rectangular cross section. It is also known for the tappet body to have, in cross section, a circular basic shape, on the outer edge of which there is however formed a radial projection which, with a depression in the tappet body guide that is fixed with respect to the housing, forms a form-fitting skewing prevention means. This, too, is considered to be disadvantageous with regard to the outlay in terms of construction and the costs.

In conjunction with the features whereby the tappet body longitudinal centerline, in a projected view oriented parallel to the geometric axis of rotation of the roller, runs with a lateral spacing to the geometric reference line, rollers incorporating teachings of the present disclosure may improve construction and cost outlays. In contrast to the prior art, the tappet body longitudinal centerline, and thus the circular cross-sectional outer contour of the tappet body, may be offset in or counter to the direction of rotation of the camshaft or of the drive shaft (in a direction perpendicular to the reference line).

Here, it may be the case that neither the roller nor the camshaft are offset relative to the pump piston. It has been found that, with such a fundamentally changed position of the tappet body relative to the reference line, skewing of the tappet body is counteracted by an opposing torque which can partially or even entirely cancel out the torque generated by an undesired asymmetrical external introduction of force. If, in said projected view, the tappet body longitudinal centerline is offset laterally with a spacing to the reference line which runs as an elongation of the piston longitudinal centerline, a frictional connection at the contact line between roller and cam gives rise to an opposing force which is in particular parallel to the contact line of roller and cam and which, with said spacing, forms an opposing torque. This counteracts an undesired torque generated by an external asymmetrical introduction of force, whereby skewing of the tappet body can be prevented.

In this way, the desired rotational position of the tappet body in which the geometric axis of rotation of the roller and the geometric axis of rotation of the camshaft run parallel to one another is stabilized. In this way, during operation, even at top dead center and at bottom dead center of the roller, skewing of the roller tappet out of said desired rotational position can be prevented or at least impeded. Some embodiments of the present teachings include replacing the known form-fitting skewing prevention means of the tappet body with a force-fitting skewing prevention means, making it possible for production tolerances to not have to be unnecessarily restricted.

Further, the outlay for a geometric, form-fitting skewing prevention means on the roller tappet can be eliminated. For example, a cylindrical bore suffices as a longitudinal guide for the tappet body, without an additional cumbersome groove or other devices. It has also been found that the desired rotational position of the tappet body is stabilized in positions of the roller between the two dead centers by virtue of the fact that, then, the roller is acted on, at the contact zone with respect to the cam, by a line load which is also directed transversely with respect to the direction of the normal to the point of contact.

In some embodiments, at least at top dead center and in particular at bottom dead center of the roller, in said projected view, the contact zone between cam and roller is situated so as to be laterally spaced apart from the tappet body longitudinal centerline. At top dead center, the spacing between the roller and the geometric axis of rotation of the camshaft is at a maximum. At bottom dead center, said spacing is at a minimum. The contact zone comprises the geometric contact line between the roller and the cam, and in particular a narrow zone of Hertzian stress which encompasses the geometric contact line.

In some embodiments, the so-called geometric reference line intersects the geometric axis of rotation of the camshaft. Expediently (that is to say not imperatively), the geometric axis of rotation of the roller runs perpendicular to the reference line. It is likewise may be the case that the geometric axis of rotation of the camshaft runs perpendicular to the reference line. The pump piston and the tappet body may be movement-coupled in any desired manner, in particular by way of additional components of the fuel pump, in the mutually opposite directions parallel to the piston longitudinal centerline. Owing to the movement coupling, the pump piston and the tappet body perform mutually synchronous movements parallel to the piston longitudinal centerline.

In some embodiments, in the projected view, the tappet body longitudinal centerline is situated on that side of the reference line which, with regard to the direction of circumferential movement of the cam, selected for operation, in the contact region of cam and roller, is situated in front of the reference line. In this case, in other words, the tappet body longitudinal centerline is, proceeding from the so-called reference line which forms an elongation of the piston longitudinal centerline, arranged laterally offset counter to the directions of rotation of the roller and cam with respect to the contact region thereof. It may alternatively be provided that, in the projected view, the tappet body longitudinal centerline is situated on that side of the reference line which, with regard to the direction of circumferential movement of the cam, selected for operation, in the contact region of cam and roller, is situated behind the reference line.

The fuel pump may comprise a cylinder chamber into which the pump piston projects and relative to which the pump piston can be moved back and forth, in directions parallel to the piston longitudinal centerline, by way of the roller tappet during a rotation of the camshaft. It is considered to be expedient for the pump piston to be guided in the cylinder chamber so as to be longitudinally displaceable in said directions. In some embodiments, the tappet body may be guided in a tappet body guide so as to be movable in directions parallel to the tappet body longitudinal centerline.

In some embodiments, a guide surface formed on the outside of the tappet may lie on or radially within an inner cylindrical envelope, for a guide surface, formed in a recess of the tappet body guide, of the tappet body guide to lie on or radially outside an outer cylindrical envelope, and for the diameter of the inner envelope to be smaller than the diameter of the outer envelope. The cylindrical envelope of the guide surface of the tappet is concentric with respect to the tappet body longitudinal centerline. In some embodiments, the guide surface of the tappet body and/or for the guide surface of the tappet body guide may run, at least in sections or entirely, cylindrically. It is considered to be expedient (that is to say, however, not imperative) for the diameter of the inner envelope and the diameter of the outer envelope to be coordinated with one another so as to realize a clearance fit or a transition fit between the tappet body and the tappet guide.

In some embodiments, the outer guide surface of the tappet and the inner guide surface of the tappet body guide run in each case in continuously cylindrical fashion along their entire respective circumference around the tappet body longitudinal centerline. This permits particularly simple production. The inwardly pointing guide surface may be produced by the formation of a cylindrical bore into the tappet body. The outwardly pointing guide surface may be produced on the tappet body by way of simple turning machining.

In some embodiments, the reference line, which forms a rectilinear elongation of the piston longitudinal centerline, and the tappet body longitudinal centerline lie in a common geometric plane which extends perpendicular to the geometric axis of rotation of the camshaft. To make it possible for the pump piston and the tappet body to be movement-coupled with regard to movements in directions parallel to the piston longitudinal centerline, the tappet body may be supported by way of a compression spring against the housing, which is adjacent to a cylinder chamber which interacts with the pump piston, and for the pump piston to be supported against the tappet body in a direction which leads away from the cylinder chamber and which is parallel to the piston longitudinal centerline.

In some embodiments, the fuel pump is a high-pressure fuel pump which compresses fuel to a pressure of over 100 bar, in particular to a pressure of between 150 and 250 bar, or to a pressure of over 1000 bar, in particular to a pressure of between 1500 and 2500 bar. For example, the fuel pump may be a gasoline injection pump or a diesel injection pump for the engine of a motor vehicle. It is however self-evident that fuel pumps according to the invention may also be used for other purposes.

It is considered to be expedient for the pump piston to have an outer guide surface which, with an inner guide surface of a pump piston guide, forms a longitudinal guide in the direction of the piston longitudinal centerline. For simple and inexpensive production, the outer guide surface of the pump piston and the inner guide surface of the pump piston guide may run, along their entire respective circumference, concentrically and cylindrically around the piston longitudinal centerline.

Firstly, with reference to FIGS. 1, 1*a* and 1*b*, components and the relative position thereof with respect to one another in the case of a known fuel pump 1' will be described. The fuel pump 1' comprises a pump piston 2', the upper longitudinal end 3' of which in the viewing direction projects into a cylinder chamber. A camshaft 4' comprises a central shaft 5' and at least one cam 6' mounted rotationally conjointly thereon (that is to say so as to be non-rotatable relative to the shaft 5'). The fuel pump 1' comprises a roller tappet 7'. Said roller tappet has a tappet body 8' and a roller 9', said roller being held on said tappet body, in a manner not illustrated in any more detail, so as to be rotatable about a central geometric (that is to say imaginary linear) axis of rotation 11'. The roller tappet 7' is arranged between the pump piston 2' and the cam 6'. The roller tappet 7' is coupled to the pump piston 2' in a manner not illustrated in FIG. 1, such that both components perform the same movements parallel to the piston longitudinal centerline 10'.

The roller 9' rolls on an outer edge 12' of the cam 6'. A piston longitudinal centerline 10' extends centrally through the pump piston 2' in the longitudinal direction thereof. The tappet body 8' extends along a tappet body longitudinal centerline 13' which is central to said tappet body. In the case of the known fuel pump 1', the tappet body longitudinal centerline 13' lies on a geometric reference line 20' which forms a rectilinear elongation of the piston longitudinal centerline 10'. Therefore, in the case of the known fuel pump 1', the piston longitudinal centerline 10' and the tappet body longitudinal centerline 13' lie on a common straight line.

The tappet body 8' is received in a tappet body guide 14' so as to be movable in directions parallel to the tappet body longitudinal centerline 13', that is to say upward and downward in FIG. 1. Said tappet body guide may be a constituent part of a housing 15' of the fuel pump 1'. To prevent undesired skewing of the tappet body 8' about its tappet body longitudinal centerline 13', the tappet body 8' and the tappet body guide 14' together form a form-fitting skewing prevention means about the tappet body longitudinal centerline 13'. In the example of FIGS. 1 and 1*a*, it is the case that, for this purpose, the tappet body 8', which is otherwise of circular outer cross section, has a radial projection 16' which engages into a groove 17', which runs parallel to the tappet body longitudinal centerline 13', in the tappet body guide 14' in a rotationally form-fitting manner with respect to the assumed direction of rotation of the roller 9' denoted by 18'. The direction of rotation of the cam 6' which corresponds to 18' is denoted by 19'.

Figure 1A:
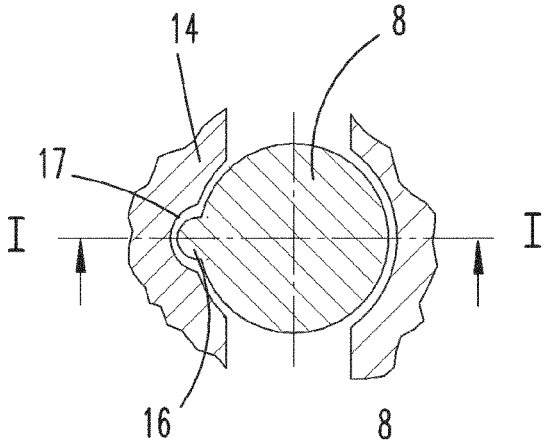
Fig. 1a (Prior Art)
FIG. 1*a* shows, in a sectional view along section line Ia-Ia in FIG. 1, a first known form-fitting skewing prevention means for the tappet body.
Figure 1B:
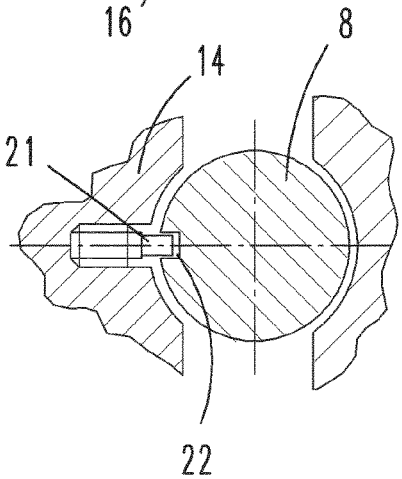
Fig. 1b (Prior Art)
FIG. 1*b* shows, in a sectional view similar to FIG. 1*a*, a second known form-fitting skewing prevention means for the tappet body, as an alternative to FIGS. 1, 1*a;*

FIG. 1*b* shows a variant, known from the prior art, with respect to FIG. 1*a*. A form-fitting skewing prevention means is formed in said variant by virtue of a peg 21' which projects radially inward in the tappet body guide 14' protruding into a groove 22', which runs parallel to the tappet body longitudinal centerline 13', in the tappet body 8'.

Figure 2:
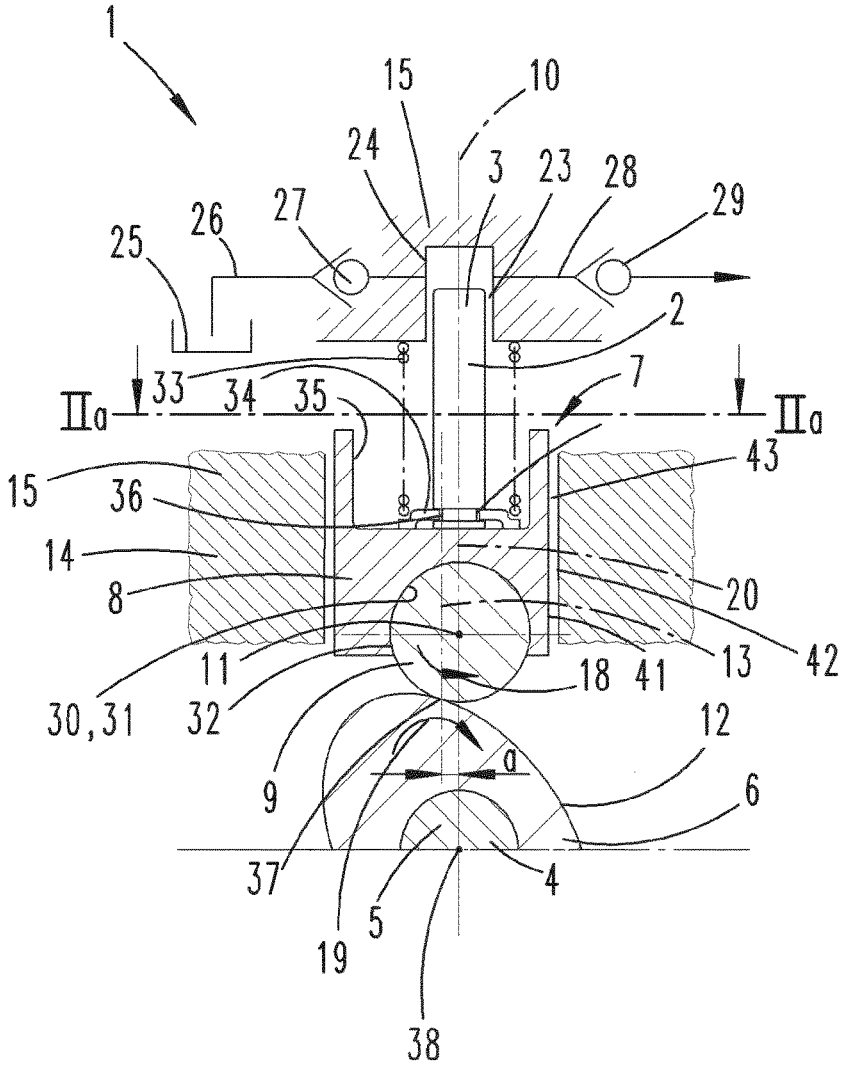
FIG. 2 shows, in a longitudinal section and in schematically simplified form, components and the arrangement thereof in the case of a fuel pump according to the invention as per a preferred exemplary embodiment.
Figure 2D:
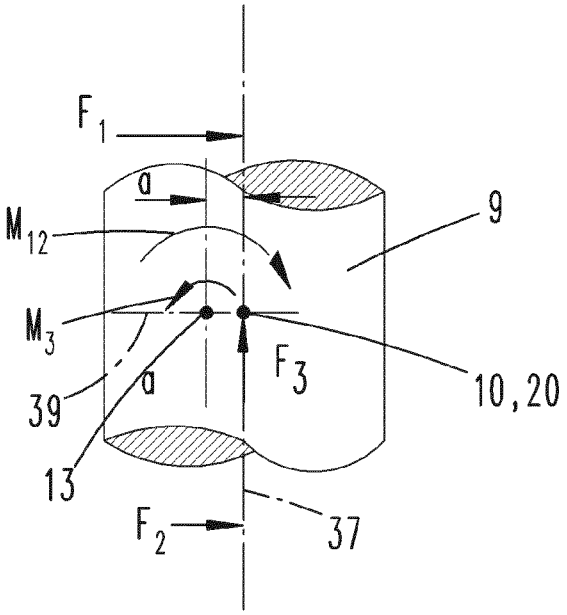
FIG. 2*d* schematically shows a plan view of a length segment of the roller with an opposing force, which stabilizes the roller in its rotational position, and a resulting opposing torque.

With reference to FIGS. 2 to 2*d*, an example fuel pump 1 incorporating teachings of the present disclosure will be described in schematically simple form. For a better overview, the same numerical reference designations have been used for components which correspond to those from FIGS. 1 to 1*b*, wherein, for distinction, the apostrophe (') suffixes of the numerals in FIGS. 1 to 1*b* have been omitted in FIGS. 2 to 2*d*.

The fuel pump 1 comprises a pump piston 2, the upper longitudinal end 3 of which as seen in the viewing direction projects into a cylinder chamber 23. The delimiting wall 24 of the cylinder chamber 23 may for example be a constituent part of the housing 15 of the fuel pump 1, or may be fixedly connected to the housing 15 thereof. In the vicinity of the face end, an inlet line 26 for fuel, which is fluidically connected to a fuel tank 25, opens into the cylinder chamber 23, in which inlet line there is arranged an intake valve 27 as inlet valve. Said intake valve is opened when the pressure in the cylinder chamber 23 falls below the pressure in the fuel tank 25 by a defined pressure difference during the suction phases. Likewise, in the vicinity of the face end, an outlet line 28 proceeds from the cylinder chamber 23, which outlet line leads for example to a high-pressure accumulator (not illustrated in FIG. 2) of an injection system for an internal combustion engine. A pressure valve 29 as outlet valve is arranged in the outlet line 28. Said pressure valve is opened during pressure phases when the fuel pressure in the cylinder chamber 23 exceeds a defined pressure.

The fuel pump has a camshaft 4 which has a central shaft 5 and at least the single cam 6, shown in FIG. 2, mounted rotationally conjointly thereon (that is to say so as to be non-rotatable relative to the shaft 5). The fuel pump 1 comprises a roller tappet 7. Said roller tappet has a tappet body 8 and has a roller 9 which is held on said tappet body, in a manner not illustrated in any more detail, so as to be rotatable about a central geometric (that is to say imaginary linear) axis of rotation 11. On its side averted from the pump piston 2, that is to say on its lower side in the view of FIG. 1, the tappet body 8 has a recess 30 for captively receiving the roller 9 such that the latter is rotatable about its cross-sectional center or about its geometric axis of rotation 11.

For this purpose, the recess 30 has a radially inwardly pointing bearing surface 31 which, in the cross section shown in FIG. 1, extends along a circular contour, specifically along a circumferential angle of greater than 180 degrees in order to prevent the roller 9 from falling out downward. The diameter of said circular contour is slightly larger than the outer diameter of the roller 9, such that the roller 9 is held rotatably. In the example, the diameters are selected so as to yield a small gap 32 which is shown in simplified form merely as a simple line in FIG. 2, into which gap fuel ingresses during operation and effects in particular hydrodynamic lubrication and plain-bearing mounting of the roller 9.

The roller tappet 7 is arranged between the pump piston 2 and the cam 6. The roller tappet 7 is movement-coupled to the pump piston such that the two components perform synchronous (and thus identical) movements in relation to the two directions parallel to the piston longitudinal centerline 10 (back and forth). The pump piston also lies in the section plane of FIG. 2 but is shown without hatching. In the exemplary embodiment shown, the tappet body 8 is supported, in the direction which leads away from the cam 5 and which is parallel to the tappet body longitudinal centerline, against a compression spring 33.

Said compression spring is supported in the same direction against the housing 15, which is adjacent to the cylinder chamber 23, of the fuel pump 1. The compression spring 33 is dimensioned such that, in every possible position of the tappet body 8, said compression spring is under spring compression force and thus pushes the tappet body 8 in the direction of the cam 6. In the example, the tappet body 8 is supported on the compression spring 33 via a spring plate 34. The spring plate 34 is arranged between the compression spring 33 and a bottom face of a bore 35 formed in the tappet body 8. Said spring plate engages, by way of the inner edge of its central opening, axially in form-fitting fashion into a groove 36 in the pump piston 2, so as to yield a form fit in the two mutually opposite axial directions that are parallel to a piston longitudinal centerline 10.

The roller 9 rolls on an outer edge 12 of the cam 6. The piston longitudinal centerline 10 runs centrally through the pump piston 2. The tappet body 8 extends along its central tappet body longitudinal centerline 13. Said tappet body is received in a tappet body guide 14 so as to be movable in directions parallel to the tappet body longitudinal centerline 13, that is to say upward and downward in FIG. 2. Said tappet body guide is illustrated only in regions in FIG. 2, and in the example, is also a constituent part of the housing 15, in which the cylinder chamber 23 is formed, of the fuel pump 1.

FIG. 2 shows a geometric or imaginary reference line 20 which forms a rectilinear elongation of the piston longitudinal centerline 10 toward the cam 6 and which intersects the geometric axis of rotation 11 of the roller 9. In the selected exemplary embodiment, the reference line 20 also intersects the geometric axis of rotation 38 of the cam 6. In the example, it is provided that the tappet body longitudinal centerline 13 and the reference line 20 lie in a common geometric plane which corresponds to the plane of the drawing of FIG. 2 and which is perpendicular to the geometric axis of rotation 38 of the camshaft 4 (cf. FIG. 2*a*).

This corresponds to the desired, non-skewed orientation of the roller tappet 7. The plane in which the tappet body longitudinal centerline 13 and the reference line 20 lie also runs perpendicular to the geometric axis of rotation 11 of the roller 9.

By contrast to the known fuel pump 1', it is the case in the fuel pump 1 according to the invention that the tappet body longitudinal centerline 13 runs with a lateral spacing a to the geometric reference line 20. Such a view with regard to a lateral spacing would also be possible, within the meaning of claim 1, if the tappet body longitudinal centerline 13 were (differently than in the example shown in FIGS. 2 and 2*a*) to lie outside the plane which is perpendicular to the geometric axis of rotation 38 of the camshaft 4 and which leads through the reference line 20. If the tappet body longitudinal centerline 13 were situated differently than in the example shown in FIGS. 2 and 2*a*, for example so as to be positionally relocated from the position shown in FIG. 2 to a position behind the plane of the drawing of FIG. 2, this would have the effect that, in a projected view oriented parallel to the axis of rotation 38, that is to say in the viewing direction of FIG. 2, the tappet body longitudinal centerline 13 again runs with a lateral spacing a to the geometric reference line 20. In the case of such a projected view, the two lines 13 and 20 are projected into a common viewing plane. In the exemplary embodiment shown in FIG. 2, it is provided that, in the projected view, the tappet body longitudinal centerline 13 lies on that side of the reference line 20 which, in relation to the direction of circumferential movement (indicated in FIG. 2 at the same time by the direction-of-rotation arrow 19) of the cam 6, selected for operation, in the contact zone 37 of cam 6 and roller 9, is situated in front of the reference line 20.

In the exemplary embodiment shown, the tappet body 8 has, on the outer side, a guide surface 41 which runs in altogether cylindrical fashion. In that region of the housing 15 of the fuel pump 1 which forms the tappet body guide 14, there is situated a bore 43, the radially inwardly pointing surface of which forms a guide surface 42 of the tappet body guide 14. The guide surface 42 likewise runs in altogether cylindrical fashion. Consequently, the tappet body 8 and the tappet body guide 14 together do not form a form fit in a direction of rotation about the tappet body longitudinal centerline 13. The pump piston 2 and the pump piston guide, which is designed for the longitudinally displaceable guidance of said pump piston in the housing 15 (and which in the example is the wall of the cylinder chamber 23), each have cylindrical guide surfaces such that the pump piston 2 and the housing 15 do not form a form fit in a direction of rotation about the piston longitudinal centerline 10.

FIGS. 2*b* and 2*c* schematically show, in a slightly different size in relation to FIG. 2*a*, a respective plan view of the roller 9, specifically in an imaginary operating state in which the roller 9 bears against the cam 6 in the edge region of its greatest eccentricity with respect to the geometric axis of rotation 38 of the camshaft 4. Said position is also referred to as top dead center. FIGS. 2*a* and 2*b* schematically show, by way of a comparative example, two different distributions of the line load, which acts on the roller 9 at the contact zone with respect to the cam 6, along the length of the contact zone 37.

In the example of FIG. 2*b*, a line load 40 which is symmetrical with respect to the roller center 39 of the roller 9 acts along the contact zone. In the case of a symmetrical line load 40, this does not give rise to skewing of the tappet body 8 even at the two dead centers of the roller 9. By contrast, FIG. 2*c* shows a line load 40 which is asymmetrical with respect to the roller center 39. If one replaces said line load with a resultant force F1 and F2 on each side of the roller center 39, said forces, spaced apart in parallel, point in the same direction but are of different magnitude, as is schematically indicated by the different arrow lengths. The uneven forces F1 and F2 that prevail as a result of an asymmetrical action of force act in each case with an equal lever arm about the roller center 39, giving rise to the torque M12, which is plotted schematically in FIG. 2*d*, about the tappet body longitudinal centerline 13.

Without countermeasures, the torque M12 could, at top dead center and at bottom dead center of the roller 9, give rise to undesired skewing of the tappet body 8 about the tappet body longitudinal centerline 13. As shown in FIG. 2*d*, in the case of the fuel pump according to the invention, owing to the lateral spacing a between the reference line 20 and the tappet body longitudinal centerline 13, skewing of the roller 9 oriented in the arrow direction of M12 would however give rise to an opposing torque M3 directed counter to the torque M12. The simplified graphic in FIG. 2*d* shows that, here, an opposing force F3 caused by the force fit at the contact line of the contact zone 37 acts with a lever arm of the length of the lateral spacing a about the tappet body longitudinal centerline 13, giving rise to the opposing torque M3. This acts about the tappet body longitudinal centerline 13 in the opposite direction of rotation in relation to the torque M12, such that the two torques partially or fully cancel one another out, whereby the roller 9 and the tappet body 8 are stabilized in a desired orientation in which the axis of rotation of the cam 6 and of the roller 9 run parallel.

List of reference designations

| | |
|---|---|
| 1, 1' | Fuel pump |
| 2, 2' | Pump piston |
| 3, 3' | Longitudinal end |
| 4, 4' | Camshaft |
| 5, 5' | Shaft |
| 6, 6' | Cam |
| 7, 7' | Roller tappet |
| 8, 8' | Tappet body |
| 9, 9' | Roller |
| 10, 10' | Piston longitudinal centerline |
| 11, 11' | Geometric axis of rotation |
| 12, 12' | Outer edge |
| 13, 13' | Tappet body longitudinal centerline |
| 14, 14' | Tappet body guide |
| 15, 15' | Housing |
| 16' | Projection |
| 17' | Groove |
| 18, 18' | Direction of rotation |
| 19, 19' | Direction of rotation |
| 20, 20' | Geometric reference line |
| 21' | Peg |
| 22' | Groove |
| 23 | Cylinder chamber |
| 24 | Delimiting wall |
| 25 | Fuel tank |
| 26 | Inlet line |
| 27 | Intake valve |
| 28 | Outlet line |
| 29 | Pressure valve |
| 30 | Recess |
| 31 | Bearing surface |
| 32 | Gap |
| 33 | Compression spring |
| 34 | Spring plate |
| 35 | Bore |
| 36 | Groove |
| 37 | Contact zone |
| 38 | Geometric axis of rotation |
| 39 | Roller center |
| 40 | Line load |

-continued

| List of reference designations | |
|---|---|
| 41 | Guide surface |
| 42 | Guide surface |
| 43 | Bore |
| a | Lateral spacing |
| $F_1$ | Force |
| $F_2$ | Force |
| $F_3$ | Opposing force |
| $M_{12}$ | Torque |
| $M_3$ | Opposing torque |

The invention claimed is:

1. A fuel pump comprising:

a pump piston having a longitudinal centerline;

a camshaft with at least one cam;

a roller tappet arranged between the pump piston and the cam; and a tappet body and a roller rotatably held on the roller tappet;

wherein the pump piston and the tappet body are movement-coupled with regard to movements in directions parallel to the piston longitudinal centerline;

the roller is in contact with the cam;

the longitudinal centerline intersects a geometric axis of rotation of the roller; and the tappet body defines a tappet body longitudinal centerline parallel to the piston longitudinal centerline and the tappet body longitudinal centerline, in a projected view oriented parallel to the geometric axis of rotation of the roller, runs with a lateral spacing to the piston longitudinal center line.

2. The fuel pump as claimed in claim 1, wherein, at least at top dead center and at bottom dead center of the roller, in the projected view, a contact zone between the cam and the roller is laterally spaced apart from the tappet body longitudinal centerline.

3. The fuel pump as claimed in claim 1, wherein the piston longitudinal centerline intersects a geometric axis of rotation of the camshaft.

4. The fuel pump as claimed claim 1, wherein, in the projected view, the tappet body longitudinal centerline is situated on a side of the piston longitudinal centerline which, with regard to the direction of circumferential movement of the cam, in the contact zone of cam and roller, in front of the piston longitudinal center line or which, with regard to the direction of circumferential movement of the cam in the contact zone of cam and roller, is situated behind the piston longitudinal centerline.

5. The fuel pump as claimed in claim 1, wherein:

the tappet body is guided in a tappet body guide and movable parallel to the tappet body longitudinal centerline;

a guide surface of the tappet body lies on or within an inner cylindrical envelope;

a guide surface of the tappet body guide lies on or outside an outer cylindrical envelope; and the diameter of the inner envelope is smaller than the diameter of the outer envelope.

6. The fuel pump as claimed in claim 5, wherein the outer guide surface of the tappet body and the inner guide surface of the tappet body guide respectively run in continuously cylindrical fashion along their entire respective circumference around the tappet body longitudinal centerline.

7. The fuel pump as claimed in claim 1, wherein the piston longitudinal centerline and the tappet body longitudinal centerline lie in a common geometrical plane extending perpendicular to a geometric axis of rotation of the camshaft.

8. The fuel pump as claimed in claim 1, wherein the tappet body is supported by a compression spring against a region of a housing of the fuel pump adjacent to a cylinder chamber interacting with the pump piston.

9. The fuel pump as claimed in claim 1, wherein the fuel pump comprises a high-pressure fuel pump for compressing fuel to a pressure of over 100 bar.

10. The fuel pump as claimed claim 1, wherein:

the pump piston comprises an outer guide surface which, with an inner guide surface of a pump piston guide, forms a longitudinal guide in the direction of the piston longitudinal centerline; and the outer guide surface of the pump piston and the inner guide surface of the pump piston guide run, along their entire respective circumference, concentrically and cylindrically around the piston longitudinal centerline.

11. The fuel pump as claimed in claim 1, wherein the pump piston is supported against the tappet body in a direction leading away from a cylinder chamber and parallel to the piston longitudinal centerline.

* * * * *